US008167670B1

(12) United States Patent
Gibson et al.

(10) Patent No.: US 8,167,670 B1
(45) Date of Patent: May 1, 2012

(54) BLOW-OFF FLOAT VEHICLE RECOVERY APPARATUS

(75) Inventors: Robert Gibson, Panama City, FL (US); Walt Hollis, Panama City, FL (US); Robert A. Leasko, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 61 days.

(21) Appl. No.: 12/924,800

(22) Filed: Sep. 20, 2010

(51) Int. Cl.
*B63B 22/06* (2006.01)

(52) U.S. Cl. ..... 441/2; 441/6; 114/336; 114/44

(58) Field of Classification Search ..... 114/312, 114/326, 336, 44, 54; 441/2, 6
See application file for complete search history.

(56) References Cited

U.S. PATENT DOCUMENTS 1,059,548 A * 4/1913 Loucks ..... 441/6
1,801,232 A * 4/1931 Gonzalez et al. ..... 114/325
2,279,829 A * 4/1942 Lyon ..... 114/326
2,374,296 A * 4/1945 Ming ..... 114/54
2,682,245 A * 6/1954 Pinch ..... 114/326
2,738,524 A * 3/1956 Peay, Jr. ..... 441/7
3,146,750 A * 9/1964 Ebbets et al. ..... 114/326
5,235,930 A * 8/1993 Pendleton ..... 114/312
5,415,577 A * 5/1995 Burns ..... 441/6
6,739,924 B1 * 5/2004 Groen et al. ..... 441/21
6,779,475 B1 * 8/2004 Crane et al. ..... 114/258
7,032,530 B1 * 4/2006 Ansay et al. ..... 114/319
7,534,152 B1 * 5/2009 Lloyd et al. ..... 441/2

* cited by examiner

*Primary Examiner* — Stephen Avila
(74) *Attorney, Agent, or Firm* — James T. Shepherd

(57) ABSTRACT

The invention in one variation is a modular recovery apparatus for dispensing a tether spool having a tow line with a float, where the tow line can be used to retrieve an unmanned underwater vehicle and other underwater platforms. The modular recovery apparatus can be triggered underwater or on the surface, and being modular in configuration it is suitable to be fitted to a variety of unmanned underwater vehicles (UUVs). The apparatus has a tether spool that is spring loaded, such that when the tether spool is deployed, the spring expels the tether spool with sufficient force to clearly separate it from the UUV. One end of the tow line is typically fastened to a tow point on the UUV, and an opposing end is attached to the float. When the tether spool is deployed, the tow line unwinds from the float, providing a securable length.

20 Claims, 7 Drawing Sheets

BLOW-OFF FLOAT VEHICLE RECOVERY APPARATUS

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to a recovery system for an unmanned underwater vehicle, and in particular to a modular recovery apparatus for dispensing a tow line with a float, where the recovery apparatus is fitted to the unmanned underwater vehicle.

2. Prior Art

Unmanned underwater vehicles have the characteristic of being easier to launch than to recover, especially in high seas. Restrictions from the sea state dictate if the mission is conducted that day. If the determination was made of the possibility of a high sea state at the time of recovery, or the UUV could not be moved to a shielded area away from the high sea state, the UUV wasn't launched. Recovery is made using a small recovery boat, and damage to the UUV is probable in high seas during recovery when the small recovery boat would hit or run over the UUV. Recovery typically employs a securing sled or a loop wire that snags a hook projecting from the UUV, and a robotic arm that secures the UUV onto the deck of the launch ship.

U.S. Pat. No. 6,779,475 to Jan W Crane and Helmut Portmann, both from Panama City Beach, Fla., discloses a launch and recovery system for unmanned underwater vehicles (UUV). The system includes a watercraft with a stern end wall movable between a vertical position and a ramp position that is angled downward toward the water surface. A storage platform mounted on the watercraft and terminating at the stern end wall defines a storage area for UUVs. An arm is pivotally mounted to the watercraft at a position forward of the storage platform. The arm has an outboard end that can be extended to positions aft of the watercraft and on either side thereof. The arm is also retractable such that its outboard end is positionable over the storage platform. A capture mechanism is mounted to the outboard end of the arm and is used to capture a UUV that maneuvers thereto in the water. A homing mechanism is coupled to the arm and is used to transmit a homing signal through the water for use by the UUV in maneuvering towards the capture mechanism.

SUMMARY OF THE INVENTION

The invention provides for a modular recovery apparatus for dispensing a tether spool having a tow line with a float, where the tow line can be used to retrieve an unmanned underwater vehicle and other underwater platforms. The modular recovery apparatus can be triggered underwater or on the surface, and being modular in configuration it is suitable to be fitted to a variety of unmanned underwater vehicles (UUVs). The term UUVs herein collectively includes remotely operated vehicles (ROVs), autonomous underwater vehicles (AUVs), and remotely operated towed vehicles (ROTVs).

An aspect of the invention is that the tow line can be coiled or wound. The modular recovery apparatus is sized to be compatible for integration onto UUVs and underwater platforms of all sizes, and can be retrofitted to existing UUVs. Another aspect of the invention is that the modular recovery apparatus can be deployed underwater and deployed on the surface, using a variety of triggering mechanisms in contact with a release controller.

In one variation of the modular recovery apparatus the tether spool is spring loaded, such that when the tether spool is deployed, the spring projects the tether spool with sufficient force to clearly separate it from the UUV. One end of the tow line is typically fastened to a tow point of the UUV, and an opposing end is attachable to the float. When the tether spool is deployed, the tow line unwinds from the tether spool, providing a securable length. The float carries the tow line toward the surface of the sea, where the tow line can be recovered with a grappling hook, boat hook, a loop, and the like. Once the tow line is recovered it can be brought onboard the recovery ship and the UUV can be pulled in for recovery.

Another variation of the invention includes a modular recovery apparatus having a compression spring loaded inside a canister. The modular recovery apparatus is typically mounted in the nose of the UUV. In one variation a trigger to deploy the float is activated with a burn wire, which in turn releases the compression spring or the tether spool pressing down the compression spring, projecting the tether spool, the net effect being that the tether spool is deployed by the spring with sufficient force to clearly separate it from the UUV. Other triggering devices including solenoids, detonating cords, pyrotechnic initiation devices, compressed gas canisters, and other actuators are anticipated. The triggering device is initiated by a release controller.

The burn wire can be actuated by a variety of methods of communication, including electromagnetic radiation—such as radio frequency (RF), infrared, light, lack of light; sound; a pressure pulse; magneto—inductive emissions; after/at a predetermined time; and having the UUV programmed to deploy the tether spool at the end of a mission. A preferred method for activation when the UUV is on the surface is via radio frequency, and acoustically when the UUV is underwater.

BRIEF DESCRIPTION OF THE DRAWINGS

The foregoing invention will become readily apparent by referring to the following detailed description and the appended drawings in which.

DETAILED DESCRIPTION OF THE INVENTION

The invention is a blow-off float vehicle recovery apparatus where the recovery apparatus is modular, and can be fitted to unmanned underwater vehicles (UUVs) making recovery of them much easier and safer. When recovery is desired the modular recovery apparatus dispenses a tether spool having a tow line with a float, where the tow line is typically attached to a tow point on the UUV. The tow point is typically located on the nose of the UUV. Deployment of the tether spool is actuated using a preferred triggering device. Following deployment, a length of tow line wound on the tether spool separates from the float either by the action of waves, the movement of the UUV relative to the float, the relative buoyancy of the float versus the UUV (if UUV is underwater the float will move toward the surface) or a combination thereof. The tow line preferably also floats, making it relatively easy to grasp, for instance using a grappling hook, a boat hook, and other line snagging tools. Once the tow line is recovered the tow line can be brought onboard the recovery ship and the UUV can be pulled in for recovery.

The modular recovery apparatus can be triggered underwater or on the surface, and being modular in configuration it is suitable to be fitted to a variety of unmanned underwater vehicles (UUVs). Illustrated variations of the invention are discussed below.

Figure 1:
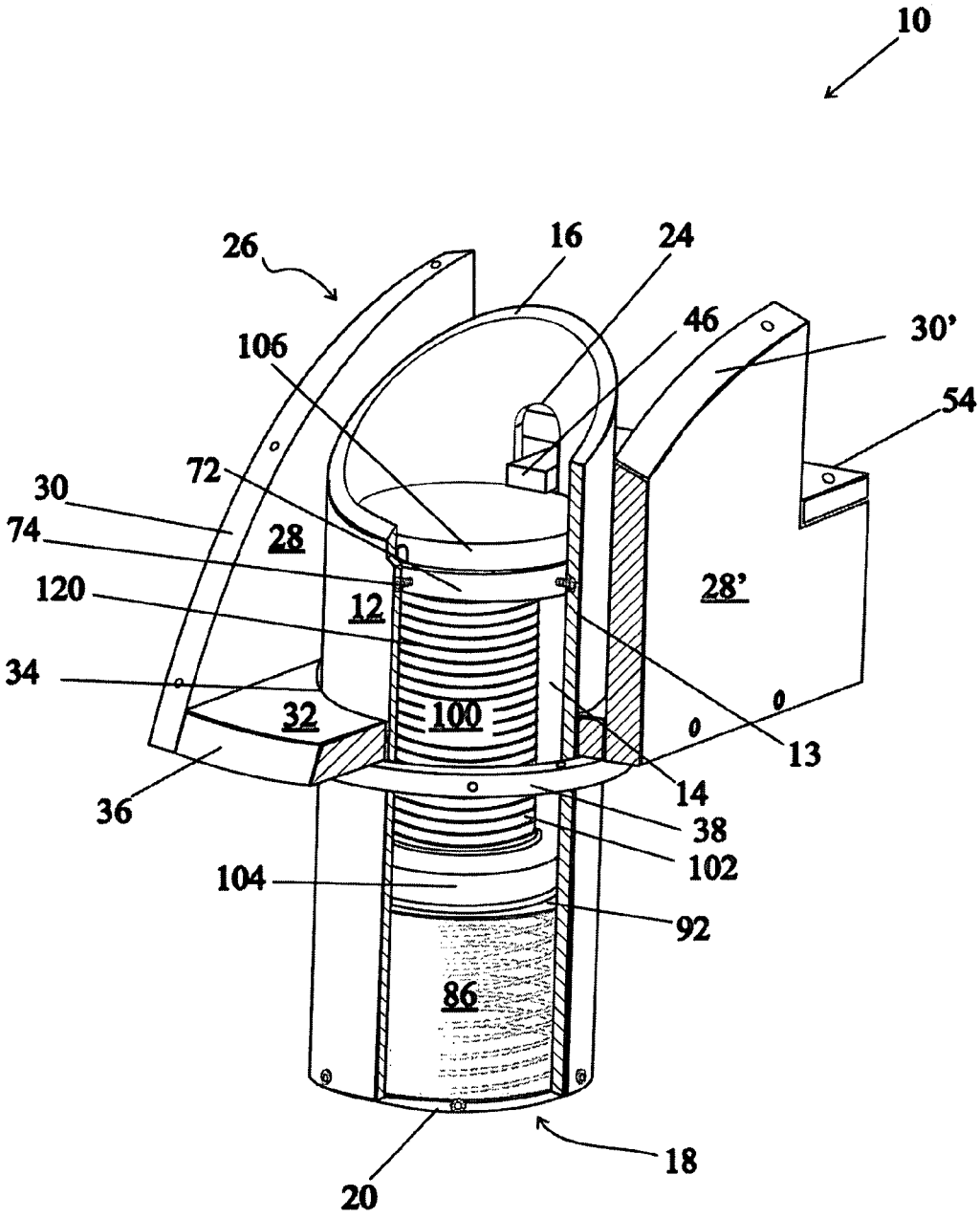
FIG. 1 is a perspective front side view of the modular recovery apparatus, wherein a portion of the canister and mounting frame is cut away to illustrate more of the elements of the invention.
Figure 2:
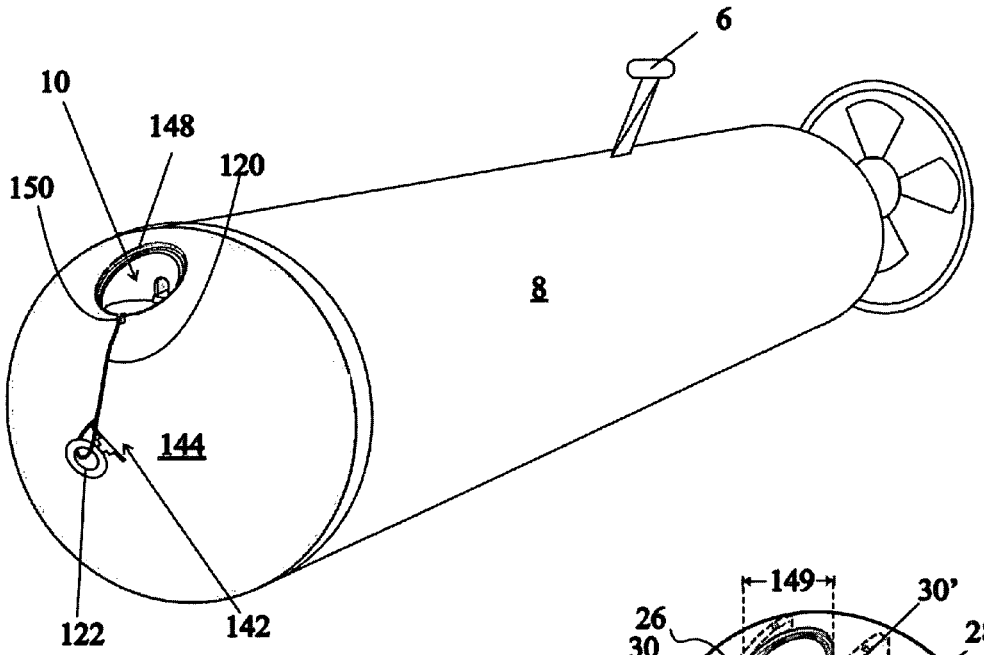
FIG. 2 is a perspective substantially frontal view of a UUV fitted with the modular recovery apparatus illustrated in FIG. 1.
Figure 3:
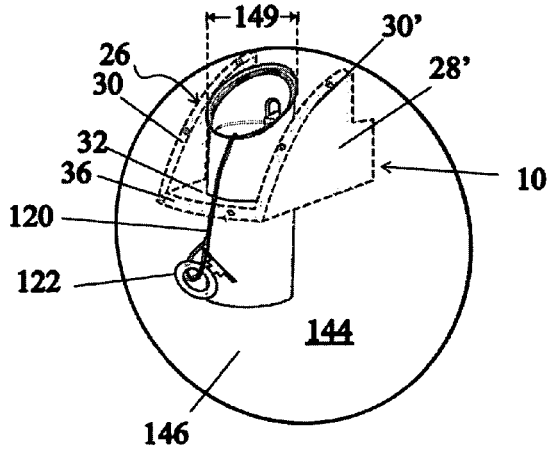
FIG. 3 is frontal view of a dome shaped nose of a UUV illustrating the orientation of the mounting frame of the modular recovery apparatus, which is shown in ghost.

Referring to FIG. 1, which is a partially cutaway perspective front side (mounting side) view of the modular recovery apparatus 10, a canister 12 is attached to a mounting frame 26. The mounting frame attaches the apparatus 10 to an interior side of a curved wall 146 of a UUV, where the wall of the UUV has an opening 148. The wall 146 and opening 148 are illustrated in FIG. 2 and FIG. 3. The mounting frame 26 includes a pair of substantially parallel plates 28, 28' separated by a distance greater than the diameter of the opening 149 (as shown in FIG. 3). Each plate has a curvilinear side 30,30' that mounts, substantially flush, with the interior side of curved wall 146. The plates 28, 28' are joined with a spanning plate 32 having a curvilinear edge 36 and an open portion 34 (in which fits the canister). The curvilinear edge 36 of the spanning plate 32 mounts substantially flush with the interior side of curved wall 146 of the UUV. The canister 12 is mounted in the open portion 34 of the spanning plate 32 utilizing a canister support ring 38. The canister support ring 38 is fastened to both the canister 12 and the spanning plate 32. In the illustrated variation the canister support ring 38 is mounted to a bottom side of the spanning plate 32, which is preferred, as the actuator assembly is located on a topside of the spanning plate 32.

The canister 12 has a substantially cylindrical wall 13 that interiorly defines a bore 14 with a bore diameter 15 (see FIG. 7), a contoured open end 16, and an opposing end 18 that preferably is partially closed. Partial closure can be achieved by casting the canister with the opposing end 18 partially closed or by fitting it with an end cap 20, as illustrated. Partial closure allows water to drain out. The contoured open end 16 mounts substantially flush with the interior side of curved wall 146 of the UUV at the opening 148 so that the rim of the open end 16 substantially conforms to or is at a smaller diameter than the edge of opening 148 to facilitate the easy exit of the tether spool from the UUV. The cylindrical wall 13 has an actuator port 24. In the illustrated variation the bore is substantially uniform in diameter, and when not latched, components within the bore can move with little frictional resistance. The composition of the materials that are used in the fabrication of the canister is selected to ensure that frictional resistance does not become an operational problem.

The canister 12 contains a compression spring 88 in a substantially hollow piston 86 that can receive the compression spring when it is compressed. The spring is suggested in FIG. 1, but it is visible in FIG. 4 and FIG. 7 in the sprung state, and in FIG. 5 in the compressed state.

Figure 7:
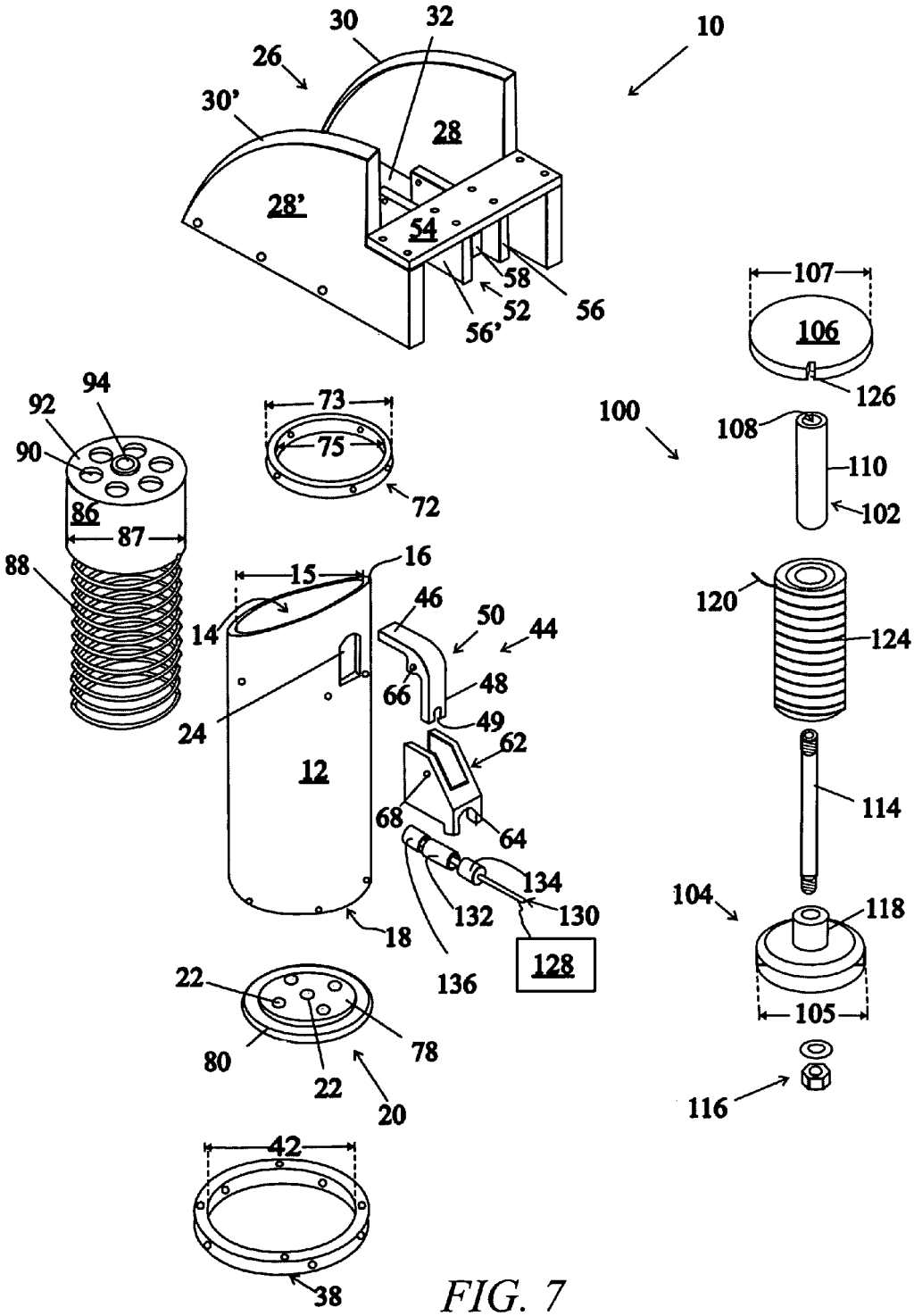
FIG. 7 is an exploded view of the modular recovery apparatus.

As shown in FIG. 7 the hollow piston 86 has a head 92 with a head diameter 87 that is less than the bore diameter 15, where the head 92 has an axial ring 94 that can center a rod-like element, such as a connecting rod 114. Typically, prior to activation, the compression spring 88 remains loaded in the hollow piston 86 in the bore of the canister 12, latched in a compressed state. In the illustrated variation the piston 86 has several holes 90 in the piston head 92 to allow passage of water. FIG. 7 is variously referred to illustrate features of the invention.

Returning to FIG. 1, the modular recovery apparatus 10 has a tether spool 100, where the tether spool 100 is wound with a tow line 120 on a float 102. The tether spool has a circular first end wall 104 with a beveled perimeter and an opposing second end wall 106. The beveled perimeter enables the tow line to be easily pulled off the tether spool. The tether spool 100 is centrally seated in the bore 14 of the canister 12, proximate to the head 92 of the hollow piston 86. The first end wall has an overall diameter 105 (as shown in FIG. 7) that is less than the head diameter 87 (as shown in FIG. 7) of the piston. The second end wall 106 functions as a cover for the apparatus and a pressure point (from the compressed spring) on the latch 46. The second end wall/cover 106 has a cover diameter 107 that is slightly smaller than the bore diameter 15, and therefore substantially occludes the bore 14. The cover diameter 107 is greater than an inside diameter 75 of a stop collar 72, so that the stop collar substantially relieves downward pressure by the latch and maintains the tether spool in an orientation that is axial with respect to the bore of the canister.

The stop collar 72 also prevents the compression spring and piston 86 from being expelled from the canister when the tether spool is deployed. Following deployment the head 92 of the piston substantially occludes access to the bore 14. The stop collar 72 is affixed in the bore 14 above the head 92 and below the second end wall 106 of the tether spool. In the illustrated embodiment thumbscrews 74 are used to set the exact position. The stop collar 72 has an outside diameter 73 that is smaller than the bore diameter 15 and an inside diameter 75 that is larger than the overall diameter 105 of the first end wall 104 of the tether spool 100, therefore while the tether spool below the second end wall 106 can easily pass, the piston head is stopped.

The modular recovery apparatus 10, as shown in the Figures, has an actuator framework 52 that includes structural elements connected to the canister 12 and the mounting frame 26 therein forming an integrated unified modular device that can be fitted to UUVs of various missions.

The latch 46 which keeps the tether spool locked in place against the piston holding the compression spring is shown in FIG. 1. The other components of the actuator assembly are discussed later.

FIG. 2 illustrates a UUV 8 fitted with the modular recovery apparatus 10. The illustrated UUV 8 has a communication element 6, for surface and underwater communication. The nose 144 of the UUV 8 is a dome shaped wall (see 146 in FIG. 4) with an opening 148 with a notch 150 for the tow line 120. The tip of the nose 144 is the tow point 142, and it has a fastening element 122 (a ring) to which is attached an end of the tow line 120 having a length of tow line wound on the tether spool 100. The modular recovery apparatus 10 is mounted on an interior side of the dome shaped wall 146 (see edge of 146 in FIG. 4).

FIG. 3 illustrates the orientation of the mounting frame 26 of modular recovery apparatus, which is shown in ghost as indicated with dashed lines. The curvilinear side 30,30',36 of each plate 28,28',32 of the mounting frame 26 mounts substantially flush with the interior side of curved wall 146. The contoured open end 16 of the canister 12, as shown in FIG. 1, is slanted and elliptical. The slanted elliptical contoured open end 16 makes the apparatus suitable for mounting the apparatus proximate to the tow point 142 of UUVs with a dome shaped nose wall 146 as the opening 148 has a slanted elliptical opening.

Figure 4:
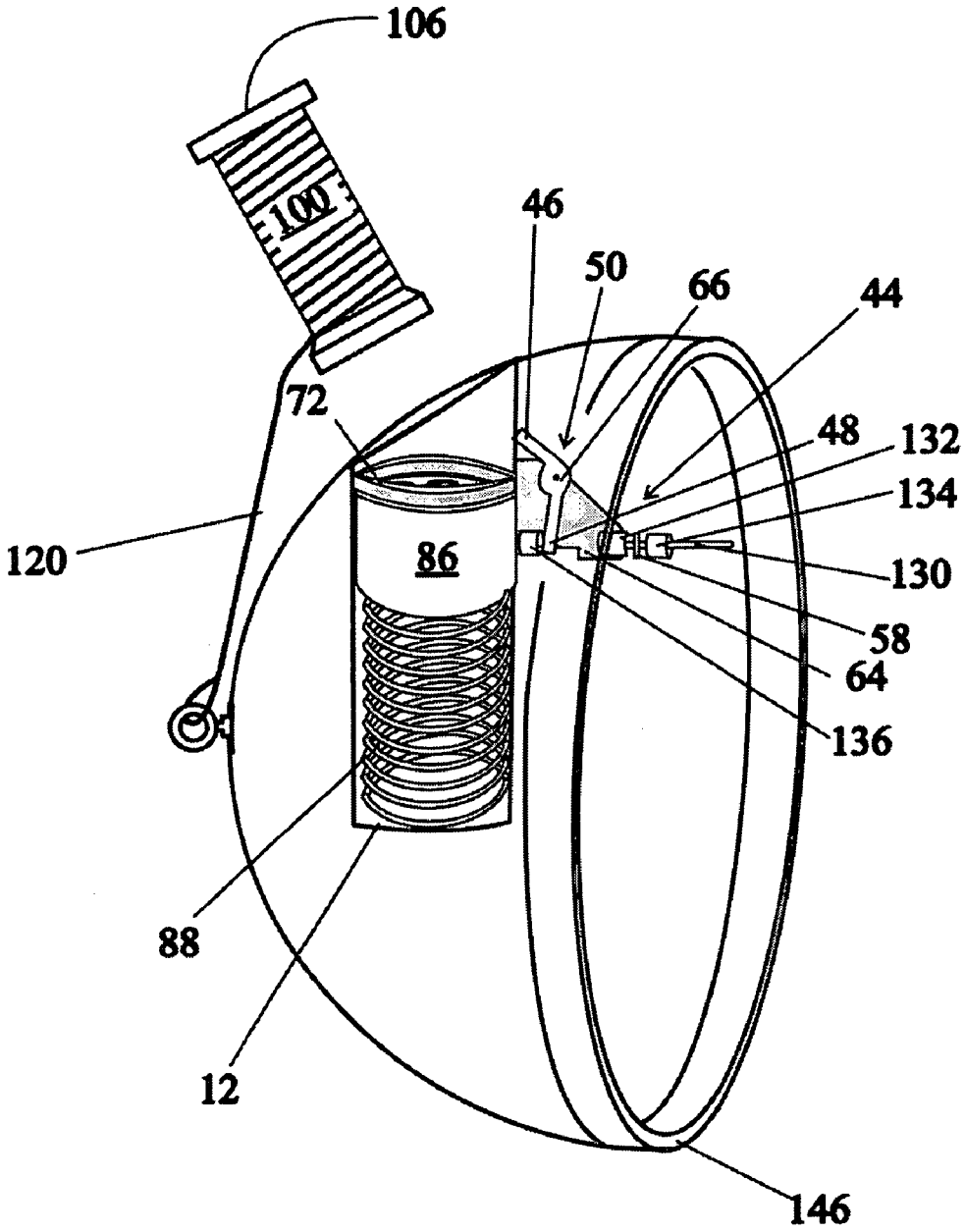
FIG. 4 is a diagrammatic side view of the modular recovery apparatus immediately after it has been actuated, therein causing the tether spool to be deployed.

FIG. 4 is a diagrammatic side view of the modular recovery apparatus 10 immediately after it has been actuated, where the tether spool 100 is expelled and the tow line is being deployed. Actuation is affected by a lever type latch assembly 44 having a triggering device that causes the release of the tether spool 100, thereby allowing compression spring 88 to expand and expel the tether spool 100 from the canister 12. The actuator assembly 44 includes a lever 50 with a latch end 46 that latches the opposing second end wall/latch cover 106, a pivot point 66 and an intersecting end 48 that intersects with the triggering device. On actuation, the triggering device releases the intersecting end 48 which is holding the latch end 46 closed. The lever 50, now free to rotate and the latch end 46 under pressure by the compression spring 88, causes the latch end 46 to pivot through the actuator port 24 (see FIG. 5) of the canister 12 away from a latched position, to an unlatched position, where the tether spool 100 is free to be expelled out of the canister.

Figure 8:
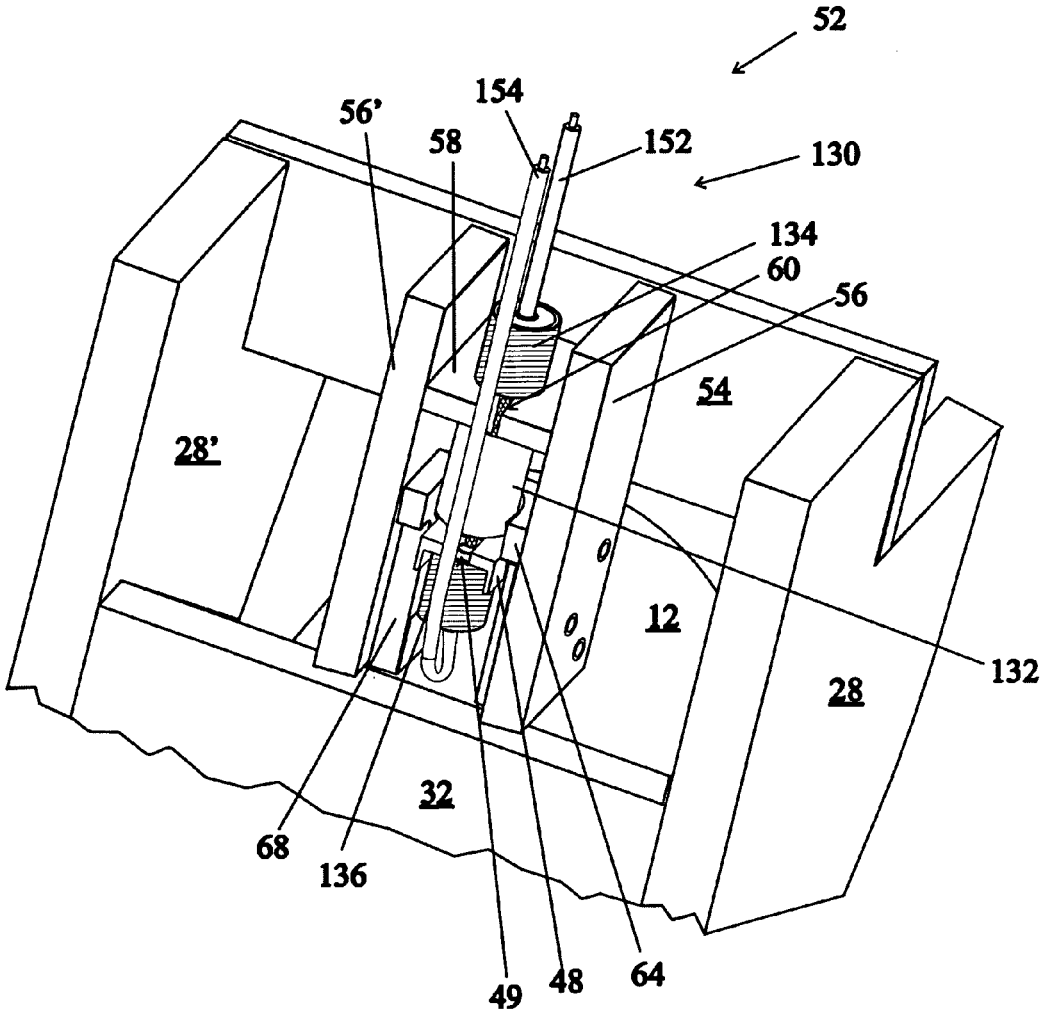
FIG. 8 is a perspective bottom side view of the modular recovery apparatus in electrical connection with a radio frequency (RF) controller for surface activation and an acoustic (sound) controller for underwater activation.

The illustrated triggering device is a burn wire 130 in electrical connection with a release controller, such as a radio frequency (RF) release controller for surface activation and/or an acoustic (sound) release controller for underwater activation, both of which can generate an electrical current. The burn wire 130 has an electrically frangible link 132 attached to a first strain relief element 134 with a first lead and a second strain relief element 136 with a second lead. An electrical current causes the electrically frangible link to break therein enabling the lever 50, no longer restrained by its connection to the burn wire 130 and driven by the force of the compression spring 88 against the latch end 46, to rotate to the unlatched position. In one variation, as shown in FIG. 8, the burn wire 130 intersects with the lever employing a housing with a static wall 58 with a groove-like aperture 60 that partitions the electrically frangible link 132 from the first strain relief element 134, a cradle 64 for the electrically frangible link, and the intersecting end 48 of the lever which is in tension connection with the second strain relief element that is connected to the electrically frangible link, where the burn wire remains tensioned until the frangible link is caused to break with an electrical current through the wire, therein allowing the lever to pivot to the unlatched position.

Figure 5:
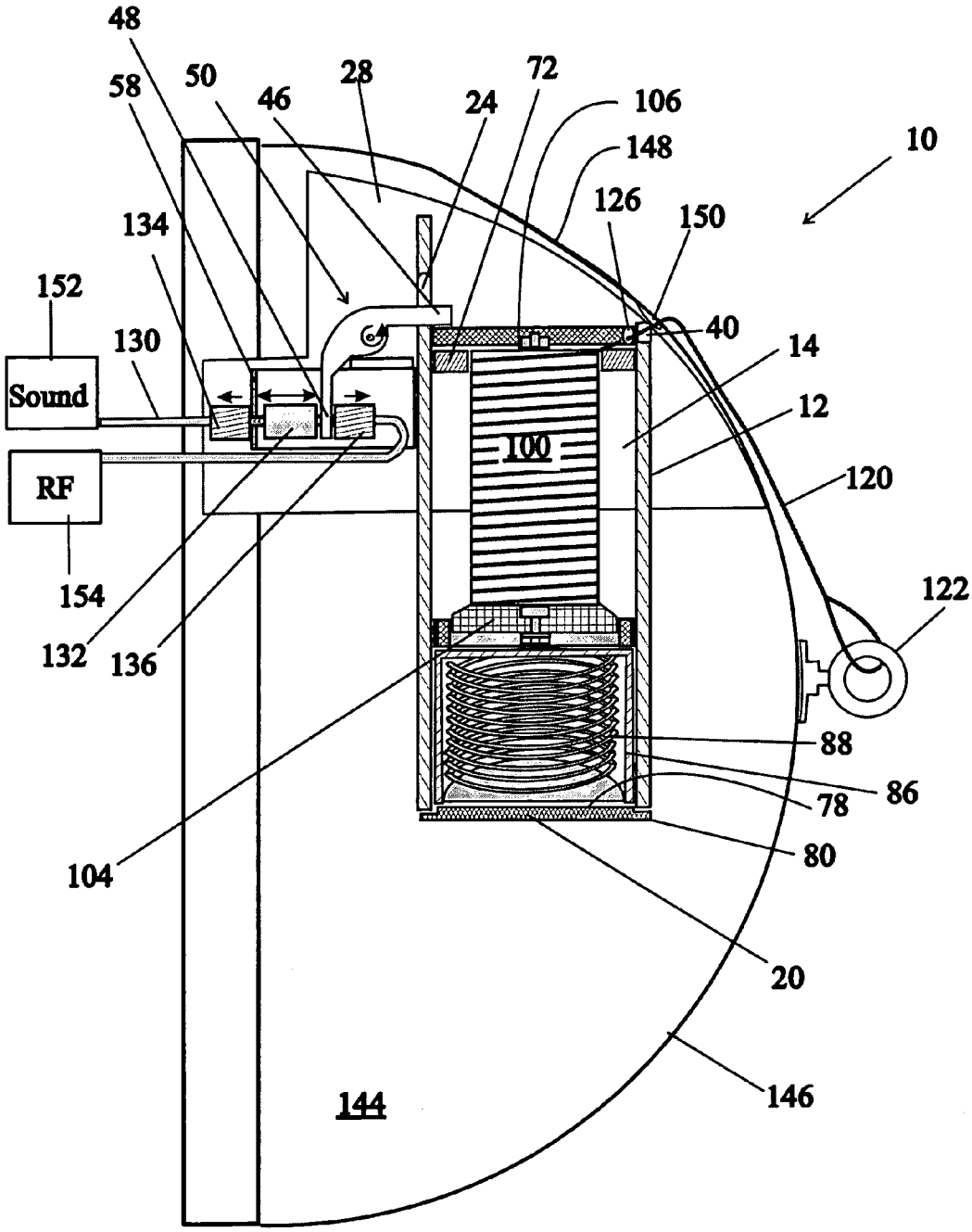
FIG. 5 is a diagrammatic side view of the modular recovery apparatus prior to actuation, and in this illustrated variation the burn wire is in electrical connection with a radio frequency (RF) controller for surface activation and an acoustic (sound) controller for underwater activation, where both controllers can generate an electrical current.

FIG. 5 provides a diagrammatic side view of the actuation of the modular recovery apparatus using a burn wire. The wire is tensioned with the first strain relief element 134 as indicated by the arrow above the first strain relief element 134 pulling to the left. Tension is created by the spring 88 pushing up causing the lever 50 to rotate counterclockwise. The intersecting end 48 of the lever is pushing the second strain relief element 136 to the right causing tension. The electrically frangible link 132 is being pulled to the left and to the right as indicated by the two headed arrow, and so long as it remains intact, the lever cannot rotate. When the frangible link 132 is caused to break, the second strain relief element 136 can move to the right. With no tension preventing the lever from rotating counterclockwise, the spring pushes the latching end 46 up and out of the way, and the tether spool is expelled from the canister and the tow line unwinds from the float.

In the illustrated variation the UUV nose 144 has a notch 150 in the wall 146 of the opening 148. There is also a notch 40 in the wall of the canister, and a notch 126 in the second end wall 106. The tow line 120 feeds through these notches onto the tether spool 100. In this illustrated variation the burn wire 130 is in electrical connection with a radio frequency (RF) controller 154 for surface activation and an acoustic (sound) controller 152 for underwater activation, where both controllers can generate an electrical current.

Figure 6:
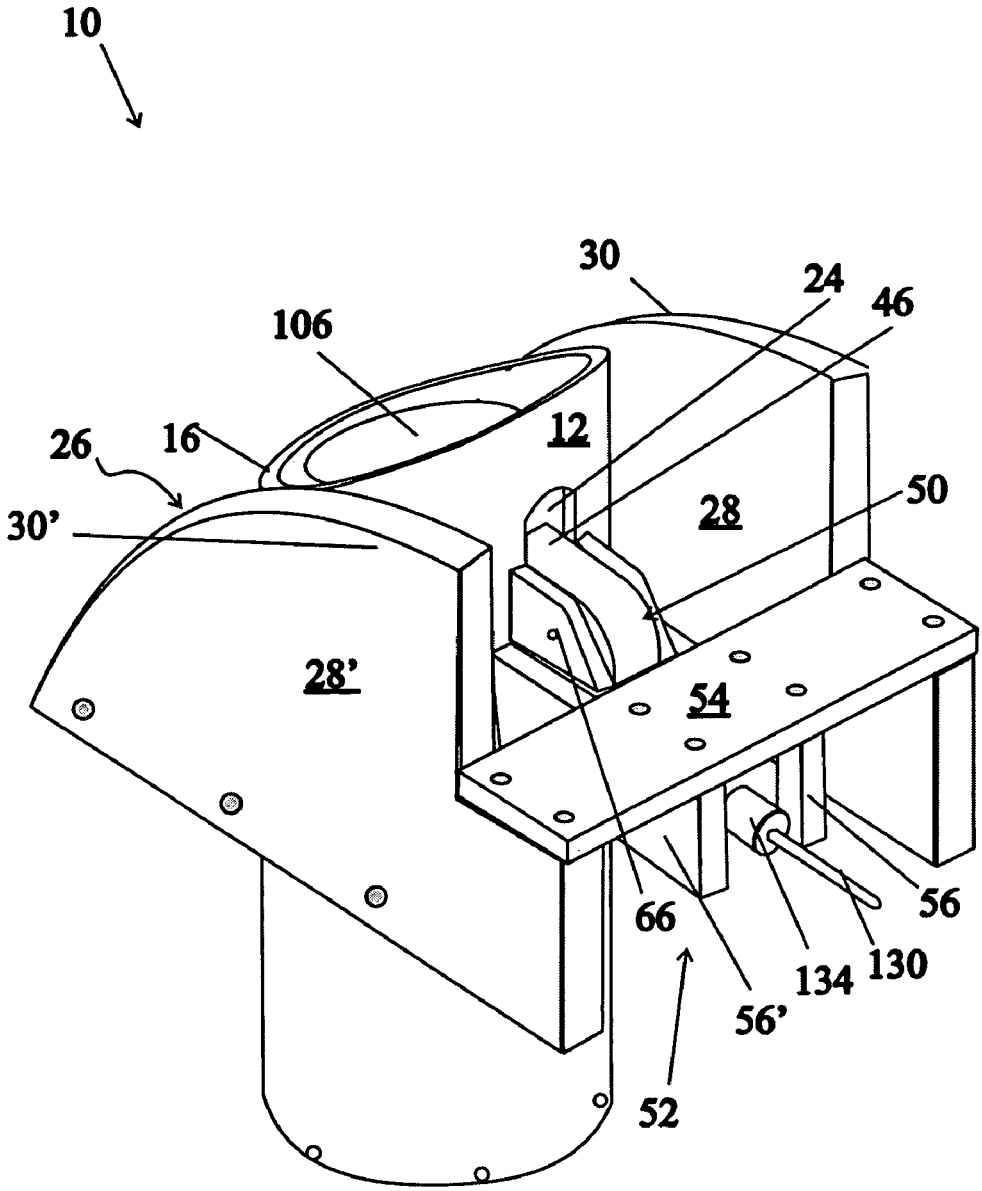
FIG. 6 is a perspective backside view of the modular recovery apparatus.

As shown in FIG. 6, which is a perspective backside view of the modular recovery apparatus 10, much of the actuator framework 52 is shown. The shelf plate 54 serves to provide support to the mounting frame 26, and a mounting element for the actuator framework 52. Plates 28,28' have risers and a platform for the shelf plate 54. Attached to the bottom of the shelf plate 54 are a pair of short plate's 56,56'. The short plates 56, 56' are substantially abutted against the canister 12 and normally seated on the spanning plate 32 of the mounting frame 26 (not visible—see FIG. 7 and FIG. 8). The burn wire 130 is positioned between the short plates 56,56'.

FIG. 8 shows the actuator framework 52 from the bottom side of the modular recovery apparatus. The short plates 56,56' are substantially parallel, joined by the static wall 58 having a groove-like aperture 60 that provides space for a section of the wire between the first strain relief element 134 and the electrically frangible link 132. The frangible link 132 is seated in a cradle 64 that is a portion of a lever support assembly 62 shown in FIG. 7. The intersecting end 48 of the lever 50 has an aperture 49 that provides space for a second section of the wire between the second strain relief element 136 and the electrically frangible link 132. The intersecting end 48 is substantially U-shaped, which in addition to making the lever stronger, also provides a defined area for the second strain relief element 136.

FIG. 7 is an exploded view of the modular recovery apparatus illustrated in FIG. 6, and gives the reader a good picture of how these various elements come together. The mounting frame 26 includes a pair of plates 28,28' each with a curvilinear side 30,30'. Plates 28,28' are joined at the bottom with a spanning plate 32, which also has a curvilinear side 36 (not visible in this view) and an open center 34 (not visible in this view) for the canister 12. Shelf plate 54 is an arbitrarily designated part of the actuator framework, as it is a base plate the joins the actuator framework 52 to the mounting frame 26. A pair of short plates 56, 56' extend from a bottom side of the shelf plate 54 to a top side of the spanning plate 32. The short plates 56, 56' are separated and joined by static plate 58. The short plates 56, 56' when assembled are substantially abutting an exterior of the canister 12, and they and the static plate provide a housing for the burn wire 130 and the lever support assembly 62.

The canister 12 is substantially cylindrical and has a bore 14 with a bore diameter 15, a contoured open end 16, and an opposing end 18. The opposing end 18 has an end cap 20 with drain holes 22. There is an undercut portion 78 that will fit in the bore 14, and an extended portion 80 that overlaps the end 18. An actuator port 24 is located near the contoured open end 16.

The canister support ring 38, having an inside diameter 42 that is greater than outside diameter 17 of the canister, is fastened to both the canister 12 and a bottom side of the spanning plate 32.

The illustrated apparatus has a hollow piston 86 with a head 92 with a head diameter 87 that is less than the bore diameter 15, where the head 92 has an axial ring 94 that can center an end of the connecting rod 114 of the tether spool 100. The compression spring 88 normally is loaded in the hollow piston 86 in the compressed state. The compressed spring provides the energy to thrust the tether spool out of the canister. In the illustrated variation the piston 86 has several holes 90 in the piston head 92 to allow passage of water.

The tether spool 100 includes a circular first end wall 104 with a beveled perimeter and a bearing 118, a connecting rod 114 attached to first end wall 104 with hardware 116, tow line 120 spooled/wound into a coil 124 on a float 102 having an axial core 108 centered on the connecting rod 114. The float 102 has a winding surface 110 through which projects the connecting rod 114. The float 102 is composed of a material that floats. The tether spool 100 has an opposing second end wall 106. The tether spool 100 is centrally seated in the bore 14 of the canister 12, proximate to the head 92 of the hollow piston 86. The first end wall has an overall diameter 105 that is less than the head diameter 87 of the piston. The second end wall 106 functions as a cover for the apparatus and a pressure point (from the compressed spring) on the latch 46. The second end wall/cover 106 has a cover diameter 107 that is slightly smaller than the bore diameter 15, and therefore substantially occludes the bore.

A stop collar 72 is affixed in the bore of the canister above the head 90 of the piston 86 and below the second end wall of the tether spool. Thumbscrews are used to set the exact position. The stop collar 72 has an outside diameter 73 that is smaller than the bore diameter 15 and an inside diameter 75 that is larger than the overall diameter 107 of the first end wall 104 of the tether spool 100. The outside diameter 107 of the second end wall/cover 106 is greater than the inside diameter 75 of stop collar 72, therefore the second end wall/cover 106 cannot move past the stop collar, however the tether spool below the first end wall 104 can easily pass. The piston head is too wide and it will be stopped.

The illustrated actuator assembly 44 includes a lever 50 with a latch end 46 that latches the tether spool, a pivot point 66, and an intersecting end 48. The intersecting end 48 has an aperture 49 that intersects with the triggering device, which is a burn wire 130 having a frangible link 132, a first strain relief element 134, and a second strain relief element 136. The lever is supported by the lever support assembly 62. The lever support assembly 62 includes a pin (not shown), a cradle 64, and a pivot receptacle 68 for the pin. The intersecting end 48 is substantially U-shaped, which in addition to making the lever stronger, also provides a defined area for the second strain relief element 136.

The burn wire 130 is electrically connected to a release controller 128, where the release controller produces an electrical current when actuated by radio waves, light waves, sound waves (acoustic signals), or magneto—inductive emissions, or when it is automatically activated at a predetermined time, after a predetermined sequence of events, or at the end of a mission.

The mounting frame 26 is preferably composed of an engineering plastic selected from the group consisting of polyoxymethylene polymer, polyoxymethylene copolymers, nylon, polycarbonate, polyetheretherketone, polyvinyl chloride, acrylonitrile butylene stryrene, polyphenylene sulfide, chlorinated polyvinyl chloride, polytetrafluoroethylene, ultra high molecular weight polyethylene, tetrafluoroethylene, ethylene tetrafluoroethylene, acrylic polymers, and methacrylic polymers.

The most preferred engineering plastic is polyoxymethylene polymer, and specifically Delrin™ made by Dupont. The canister 12 and elements of the actuating framework including the shelf plate 54 and the pair of short plates 58, 58' can also be primarily composed of a similar engineering plastic. Delrin has a relatively low coefficient of friction and is resistant to weathering.

The tow line is preferably composed of a material or combination of materials that floats. Examples include polyethylene and polypropylene. Nylon has a specific gravity that is comparable to seawater. Polyesters, polyamides, polyimides and aramides have a higher specific gravity, and would not float. Lines having a core of nylon, acrylic polymers and ethylene acrylic copolymer covered with an olefinic polymer, like polyethylene, will float.

The engineering plastic can be molded and then machined to have the final construction used in the apparatus.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A modular recovery apparatus comprising:

a mounting frame for attaching the apparatus to a wall of a UUV;

a canister affixed to the mounting frame with a canister support ring, said canister comprised of a substantially cylindrical wall that interiorly defines a bore with a bore diameter, a contoured open end and an opposing end, and an actuator port located in the cylindrical wall;

a substantially hollow piston having a head with a head diameter that is less than the bore diameter, where the head has an axial ring that can center a rod-like element;

a compression spring compressed in the substantially hollow piston;

a tether spool for insertion into said bore, said tether spool comprising a float having an axial core, a circular first end wall with a beveled perimeter, wherein the beveled perimeter enables a tow line that is wound around the tether spool to be easily pulled off the tether spool, where said first end wall has an overall diameter that is smaller than the head diameter of the piston, where said tether spool is further comprised of an opposing second end wall having a cover diameter that is smaller than the bore diameter, such that the second end wall substantially occludes the bore;

a stop collar that prevents the piston from escaping from the canister when the tether spool is expelled, where the stop collar is affixed in the bore of the canister above the piston and below the second end wall of the tether spool, said stop collar having an outside diameter that is smaller than the bore diameter and an inside diameter that is smaller than the cover diameter of the second end wall and larger than the overall diameter of the first end wall of the tether spool, such that only the second end wall of tether spool is stopped by the stop collar;

an actuator framework coupled to the canister and the mounting frame; and an actuator assembly mounted on the actuator framework and having a triggering device that can cause the tether spool to be deployed, said actuator assembly having a lever with a latch end that latches the opposing second end wall, a pivot point and an intersecting end that is coupled to the triggering device, where upon being activated the latch end pivots through the actuator port of the canister away from a latched position, where the tether spool is latched, moving to an unlatched position, where the tether spool is no longer latched, said triggering device being a burn wire in electrical connection with a release controller which can generate an electrical current, said burn wire having an electrically frangible link attached to a first strain relief element and a second strain relief element, wherein the electrical current causes the electrically frangible link to break therein enabling the lever, driven by the compression spring, to rotate to the unlatched position;

wherein at activation the tether spool is expelled from the canister and the tow line unwinds from the float.

2. The apparatus according to claim 1, wherein said mounting frame is shaped to be mounted substantially flush onto an interior side of a curved wall of the UUV, and wherein said contoured open end of said canister is shaped to be mounted substantially flush to the interior side of the UUV at an opening therein.

3. The apparatus according to claim 2, wherein the mounting frame comprises a pair of substantially parallel plates separated by a distance greater than the diameter of the opening in the UUV, where each plate has a curvilinear side that is shaped to mount substantially flush with the interior curved wall.

4. The apparatus according to claim 3, wherein said pair of plates are joined with a spanning plate having a curvilinear edge and an open portion, where the curvilinear edge of the spanning plate is shaped to mount substantially flush with the interior side of the curved wall of the UUV.

5. The apparatus according to claim 4, wherein said canister is mounted in the open portion of the spanning plate.

6. The apparatus according to claim 5 wherein said canister support ring is fastened to the canister and the spanning plate.

7. The apparatus according to claim 1, wherein the contoured open end of the canister has a slanted elliptical opening, said slanted elliptical opening making the apparatus suitable for mounting the apparatus proximate to the tow point of the UUV with a dome shaped nose wall having an opening that is a tether spool expulsion port.

8. The apparatus according to claim 4, wherein the actuator framework comprises a shelf plate which provides a joining structural member for the pair of substantially parallel plates of the mounting frame and a base for the actuator framework, a pair of short plates that extend from a bottom side of the shelf plate to a top side of the spanning plate substantially abutting an exterior of the canister, said pair of short plates providing a housing for the burn wire.

9. The apparatus according to claim 8, wherein the housing for the burn wire further comprises a static wall with a groove-like aperture that partitions the electrically frangible link from the first strain relief element, a cradle for the electrically frangible link, and the intersecting end of the lever which is in tension connection with the second strain relief element that is connected to the electrically frangible link, where the burn wire remains tensioned until the frangible link is caused to break with an electrical current through the wire, therein allowing the lever to pivot to the unlatched position.

10. The apparatus according to claim 1 wherein said frame is primarily composed of an engineering plastic selected from the group consisting of polyoxymethylene polymer, polyoxymethylene copolymers, nylon, polycarbonate, polyetheretherketone, polyvinyl chloride, acrylonitrile butylene stryrene, polyphenylene sulfide, chlorinated polyvinyl chloride, polytetrafluoroethylene, ultra high molecular weight polyethylene, tetrafluoroethylene, ethylene tetrafluoroethylene, acrylic polymers, and methacrylic polymers.

11. The apparatus according to claim 10 wherein said canister is primarily composed of an engineering plastic selected from the group consisting of polyoxymethylene polymer, polyoxymethylene copolymers, nylon, polycarbonate, polyetheretherketone, polyvinyl chloride, acrylonitrile butylene stryrene, polyphenylene sulfide, chlorinated polyvinyl chloride, polytetrafluoroethylene, ultra high molecular weight polyethylene, tetrafluoroethylene, ethylene tetrafluoroethylene, acrylic polymers, and methacrylic polymers.

12. The apparatus according to claim 11 wherein said shelf plate and said pair of short plates are primarily composed of an engineering plastic selected from the group consisting of polyoxymethylene polymer, polyoxymethylene copolymers, nylon, polycarbonate, polyetheretherketone, polyvinyl chloride, acrylonitrile butylene stryrene, polyphenylene sulfide, chlorinated polyvinyl chloride, polytetrafluoroethylene, ultra high molecular weight polyethylene, tetrafluoroethylene, ethylene tetrafluoroethylene, acrylic polymers, and methacrylic polymers.

13. A modular recovery apparatus comprising:

a mounting frame for attaching the apparatus to a wall of a UUV, said mounting frame having a pair of substantially parallel plates and a spanning plate joining the parallel plates;

a canister affixed to the mounting frame with a canister support ring, said canister comprised of a wall that interiorly defines a bore with a bore diameter, a contoured open end and an opposing end that is fitted with an end cap, and an actuator port located in the wall near the contoured open end;

a substantially hollow piston having a head with a head diameter that is less than the bore diameter, where the head has drain holes;

a compression spring compressed in the piston;

a tether spool comprised of a tow line wound on a float having a circular first end wall with a beveled perimeter and an opposing second end wall, where said first end wall is centrally seated in the bore of the canister proximate to the head of the piston;

a stop collar that prevents the piston from escaping from the canister when the tether spool is expelled, where the stop collar is affixed in the bore of the canister above the piston and below the second end wall of the tether spool, said stop collar having an outside diameter that is smaller than the bore diameter and an inside diameter that is smaller than the diameter of the second end wall and larger than the overall diameter of the first end wall, such that only the second end wall of the tether spool is stopped by the stop collar;

an actuator framework comprised of a shelf plate, a pair of short plates that extend from a bottom side of the shelf plate to a top side of the spanning plate substantially abutting an exterior of the canister; and an actuator assembly mounted to the actuator framework having a triggering device that can cause the tether spool to be deployed, said triggering device being in electrical connection with a release controller.

14. The apparatus according to claim 13, wherein the apparatus is adapted to be mounted on an interior side of a nose wall with an opening proximate to a tow point of the UUV.

15. The apparatus according to claim 13, wherein the mounting frame and the canister are primarily composed of an engineering plastic selected from the group consisting of polyoxymethylene polymer, polyoxymethylene copolymers, nylon, polycarbonate, polyetheretherketone, polyvinyl chloride, acrylonitrile butylene stryrene, polyphenylene sulfide, chlorinated polyvinyl chloride, polytetrafluoroethylene, ultra high molecular weight polyethylene, tetrafluoroethylene, ethylene tetrafluoroethylene, acrylic polymers, and methacrylic polymers.

16. The apparatus according to claim 13, wherein said triggering device is a burn wire having an electrically frangible link, and wherein said burn wire is in electrical connection with a release controller that can generate an electrical current that causes said electrically frangible link to fail, thereby allowing the tether spool to be deployed.

17. The apparatus according to claim 16, wherein the release controller is capable of being actuated by radio waves.

18. The apparatus according to claim 16, wherein the release controller is capable of being actuated by acoustic signals.

19. A modular recovery apparatus comprising:

a mounting frame for attaching the apparatus to an interior side of a wall of a UUV, said mounting frame having a pair of substantially parallel plates joined with a spanning plate that has an open portion;

a canister comprised of a wall that interiorly defines a bore with a bore diameter, a contoured open end and an opposing end that is fitted with an end cap, and an actuator port located in the wall near the contoured open end;

a canister support ring, said canister support ring joining the canister to the spanning plate, where the canister is mounted in the open portion;

a piston that is substantially hollow;

a compression spring compressed in the piston;

a tether spool comprised of a tow line wound on a float having a circular first end wall and an opposing second end wall, where said first end wall is centrally seated in the bore of the canister proximate to the piston;

a stop collar affixed in the bore of the canister above the piston and below the second end wall of the tether spool, said stop collar having an outside diameter that is smaller than the bore diameter and an inside diameter that is smaller than the diameter of the second end wall and larger than the diameter of the first end wall;

an actuator framework comprised of a shelf plate, a pair of short plates that extend from a bottom side of the shelf plate to a top side of the spanning plate substantially abutting an exterior of the canister; and an actuator assembly having a triggering device that can cause the tether spool to be deployed, said triggering device in electrical connection with a release controller.

20. The apparatus according to claim 19, wherein said triggering device is a burn wire in electrical connection with the release controller and the release controller can generate and provide an electrical current to the burn wire, thereby causing the burn wire to break and release the tether spool.

* * * * *